US006142157A

United States Patent [19]

de Laforcade

[11] Patent Number: 6,142,157

[45] Date of Patent: Nov. 7, 2000

[54] APPLICATOR SYSTEM AND METHOD FOR APPLYING A HAIR PRODUCT TO HAIR

[75] Inventor: Vincent de Laforcade, Rambouillet, France

[73] Assignee: L'Oréal S.A., Paris, France

[21] Appl. No.: 09/249,072

[22] Filed: Feb. 12, 1999

[30] Foreign Application Priority Data

Feb. 12, 1998 [FR] France ..... 9801698

[51] Int. Cl.[7] ..... A61K 7/13

[52] U.S. Cl. ..... 132/208; 132/317; 132/320; 15/186; 15/187; 15/188; D4/134

[58] Field of Search ..... 132/202, 207, 132/208, 209, 317, 320; 15/159.1, 160, 167.1, 186, 187, 188; D4/130, 131, 132, 133, 134, 135, 136, 137, 138; 401/122, 126, 127

[56] References Cited

U.S. PATENT DOCUMENTS

| | | | |
|---|---|---|---|
| D. 41,870 | 10/1911 | Homan | D4/134 |
| D. 46,754 | 12/1914 | Smith | D4/134 |
| D. 54,565 | 3/1920 | Stiles | D4/134 |
| D. 68,587 | 10/1925 | Nevius | D4/134 |
| 2,218,862 | 10/1940 | Vredenburgh | 132/320 |
| 3,008,164 | 11/1961 | Herman et al. | 15/160 |
| 3,960,160 | 6/1976 | Hogan | 132/207 |
| 4,694,525 | 9/1987 | Yamamoto et al. | 15/186 |
| 4,881,558 | 11/1989 | Hollenberg et al. . | |

FOREIGN PATENT DOCUMENTS

| | | |
|---|---|---|
| 0 474 934 | 3/1992 | European Pat. Off. . |
| 726 157 | 5/1932 | France . |
| 2 728 444 | 6/1996 | France . |

*Primary Examiner*—Pedro Philogene
*Attorney, Agent, or Firm*—Finnegan, Henderson, Farabow, Garrett & Dunner, L.L.P.

[57] ABSTRACT

An applicator for a hair product includes a handle having at least a first end, a second end, and a longitudinal axis, and a brush on the first end of the handle. The brush includes a base and a plurality of brush members extending from the base. The base has at least three protrusion including a first protrusion extending in a first direction substantially perpendicular to the longitudinal axis of the handle, a second protrusion extending in a second direction substantially opposite to the first direction and substantially perpendicular to the longitudinal axis of the handle, and a third protrusion extending in a third direction facing away from the handle and substantially parallel to the longitudinal axis of the handle. Also disclosed are systems for applying a hair product to hair and methods for applying a hair coloring with an applicator.

30 Claims, 5 Drawing Sheets

APPLICATOR SYSTEM AND METHOD FOR APPLYING A HAIR PRODUCT TO HAIR

Under the provisions of 35 U.S.C. § 119, this application claims priority of French Patent Application No. 9801698, filed Feb. 12, 1998, the disclosure of which is incorporated herein by reference.

The present invention relates to an applicator for a hair product, such as a hair coloring that has the consistency of mousse, gel, or cream. The present invention also relates to a system for applying a hair product to hair and a method for applying a hair coloring to hair with an applicator.

A current fashion trend involves coloring the hair to create a visual effect, which is either pronounced or subtle, depending on the preference of the individual. For example, to produce a pronounced visual effect, the individual may apply a hair product including vivid cosmetic colors, such as yellow, green, blue, or red. In the alternative, the individual may apply color to give the hair a special appearance. Unfortunately, with conventional hair coloring applicators, only skilled hair color technicians are able to apply color to the hair to achieve a very subtle and natural appearance.

Of these special appearances created with color, the most popular is using color to create areas of the hair, as opposed to complete locks, which are lighter or darker in color than the rest of the hair. Shading the hair in this manner gives the overall hair style a very natural appearance.

Coloring compositions can be packaged in various types of containers. For example, the coloring composition may be packaged in a mixing device suitable for hand-mixing the different components that make up the composition (generally a dye and an oxidizing agent) at the time of use. In the alternative, the coloring composition may be packaged pre-mixed in a pressurized container.

The aforementioned hair effects are produced with the aid of coloring compositions, generally in the form of a gel, paste, mousse, or cream. Regardless of the type of container or the form of the composition, the coloring composition is deposited on an applicator and then applied to the hair.

Although conventional home coloring kits have been on the market for some time, conventional applicators suffer from the drawback of requiring use by a highly skilled user to avoid creating color lines toward the roots of the hair. This tendency to produce color lines results from the configuration of conventional applicators. In particular, if the portion of the applicator that is placed near the roots of the hair ("starting portion") is substantially straight or has a large radius of curvature, the applicator tends to create an undesirable color line where the applicator is first placed on the hair ("starting zone"). In the interest of creating a large surface area for quickly applying the coloring composition, conventional applicators are configured to have a starting portion substantially straight or with a large radius of curvature.

Examples of conventional applicators are illustrated in FIGS. 1A and 1B. These figures illustrate the application of a hair coloring product to hair using an applicator having an elongate brush (in the shape of a rugby ball). In FIG. 1A, the major axis of the brush is substantially perpendicular to the axis of the handle. In FIG. 1B, the major axis of the brush is substantially parallel to the axis of the handle. In both cases, however, the applicators are designed for the user to orient the applicator so that one of the major faces 1 of the applicator is the starting portion of the applicator.

For both of the conventional applicators disclosed in the FIGS. 1A and 1B, the user moves the applicator along a lock of hair by pulling the applicator in a direction perpendicular to its major axis. However, because of the large radius of curvature of these brushes, they create a color line 2 (or a color curve with a large radius of curvature) in the hair. This color line 2 is not natural-looking and therefore, perceived very negatively by users.

Attempts have been made to solve this color line problem by using an applicator having a brush with a circular shape. However, to maintain an application surface area large enough to cover a sufficient width of hair, the radius of the brush is quite large. Thus, having a round brush with a large radius results in the same color line problem as the oval brush, although to a somewhat lesser degree.

In light of the foregoing, there is a need in the art for an improved hair product applicator.

Accordingly, the present invention is directed to a hair product applicator that obviates one or more of the shortcomings of the related art.

A preferred object of the invention is to provide an applicator having a brush that does not have a straight starting portion or a starting portion with a large radius of curvature.

Another preferred object of the invention is to provide a system including one of the applicators of the present invention and a container for containing a hair product.

It should be understood that the invention could still be practiced without performing one or more of the preferred objects and/or advantages set forth above. Still other objects will become apparent after reading the following description of the invention.

To achieve these and other advantages, and in accordance with the purpose of the invention, as embodied and broadly described herein, the invention includes an applicator including a handle having at least a first end, a second end, and a longitudinal axis. The applicator further includes a brush on the first end of the handle. The brush includes a base and a plurality of brush members extending from the base. The base has at least three protrusions, including a first protrusion extending in a first direction substantially perpendicular to the longitudinal axis of the handle, a second protrusion extending in a second direction substantially opposite to the first direction and substantially perpendicular to the longitudinal axis of the handle, and a third protrusion extending in a third direction facing away from the handle and substantially parallel to the longitudinal axis of the handle.

In a further aspect, the base of the brush lacks any edges substantially parallel to the longitudinal axis of the handle.

In another aspect, the at least three protrusions are curved and have a radius of curvature. Preferably, the radius of curvature is from about 1 mm to about 15 mm. More preferably, the radius of curvature is from about 2 mm to about 10 mm.

In yet another aspect, the base of the brush has a plurality of side edges, wherein each of the at least three protrusions is a corner formed by the intersection of two respective side edges of the base. Preferably, the two respective side edges form a right angle.

In still another aspect, the first protrusion and the second protrusion are aligned substantially along a line substantially perpendicular to the longitudinal axis of the handle and the third protrusion is substantially aligned with the longitudinal axis of the handle.

In another aspect, the base includes a fourth protrusion extending in a fourth direction substantially opposite to the third direction.

In a further aspect, the third protrusion and the fourth protrusion are substantially aligned with the longitudinal axis of the handle.

In yet a further aspect, the base includes concavely curved side edges between the at least three protrusions.

In another aspect, a surface of the base has concave curvature and the free ends of the brush members define a surface having concave curvature. In a preferred embodiment, the brush is configured so that the concave curvature of the base faces away from the concave curvature defined by the free ends of the brush.

In still another aspect, the applicator is molded from a thermoplastic material. Preferably, the thermoplastic material is chosen from polypropylene and polyethylene.

In a further aspect, the invention includes a system for applying hair product to hair, including one of the applicators described above and a container for containing the hair product. Preferably, the container includes a bowl. In an alternate embodiment, the container is a mixer. In still another embodiment, the container is pressurized to facilitate dispensing the hair product.

In another aspect, the invention includes a method for applying hair coloring to hair with an applicator having a base including a plurality of brush members and a plurality of protrusions. The method involves placing the hair coloring on the brush members and then positioning the applicator on a lock of hair so that at least one of the protrusions faces in a first direction facing substantially toward roots of the hair. Thereafter, the method includes moving the applicator in a second direction along the lock of hair to transfer the hair coloring from the brush members to the hair. The second direction is substantially opposite to the first direction so that the at least one protrusion limits formation of a substantially straight initial color line Preferably, regardless of how the user orients the handle of the applicator relative to the hair, the starting portion of the brush always includes an angular zone or a zone with a short radius of curvature, which prevents the applicator from creating one of the undesirable color lines discussed above. Preferably, the applicator can be used in the same way by a left-handed or a right-handed person. Advantageously, the applicator of the present invention maintains a large enough application area to enable a sufficiently rapid and effective application.

Preferably, the first and second protrusions extend in directions substantially opposite to one another and substantially perpendicular to the longitudinal axis of the handle. In a preferred embodiment, the first protrusion and the second protrusion are aligned substantially along a line perpendicular to the longitudinal axis of the handle and the third protrusion is substantially aligned with the longitudinal axis of the handle. According to this embodiment, the applicator is substantially symmetric and has the same characteristics of application when used by a left-handed person or by a right-handed person.

Preferably, the applicator includes a fourth protrusion extending in a fourth direction substantially opposite to the third direction. In a more preferred embodiment, the third and fourth protrusions are substantially aligned with the longitudinal axis of the handle. Preferably, the base lacks any edges substantially perpendicular to the longitudinal axis of the handle. This configuration increases the effective area of application, while not creating an undesirable color line with the starting portion of the applicator.

In a preferred embodiment, the protrusions are separated by concave curved portions.

In an alternate embodiment, the base has a plurality of side edges and the protrusions are corners formed by two respective side edges of the base. Preferably, the two respective side edges forming the corner form a right angle.

Preferably, the brush members are chosen from teeth and bristles. Preferably, each protrusion is curved and has a radius of curvature greater than or equal to the radius of the circle circumscribed by one tooth or by one tuft of bristles. Preferably, the upper limit of the radius of curvature for each protrusion is the radius of a circle circumscribing a section of the brush. This configuration is preferred to provide the brush with a sufficient area and with a configuration having protrusions joined by concave edges, which corresponds to a preferred configuration of the applicator according to the invention.

Preferably, the applicator is molded from thermoplastic material. For example, the applicator may be molded from polypropylene or polyethylene. Molding with thermoplastic material is preferred because it has a very low cost and allows the use of conventional industrial molding techniques.

Besides the structural arrangements and method steps set forth above, the invention could include a number of other arrangements and method steps, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIGS. 1A and 1B are views showing the use of conventional applicators and problems associated therewith;

Figure 6:
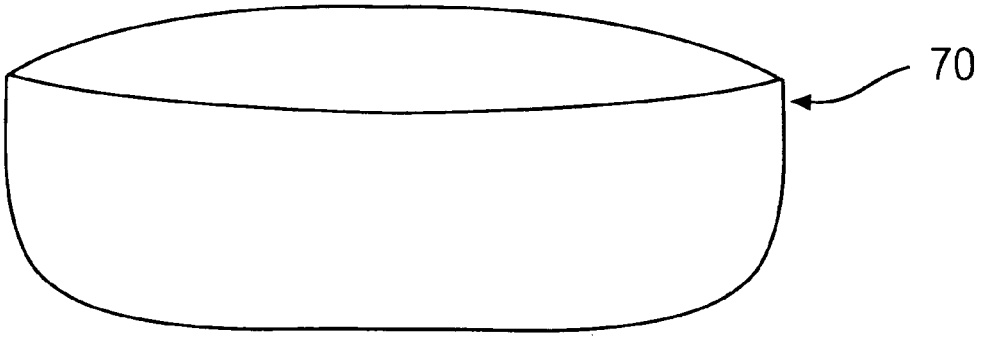
Figure 7:
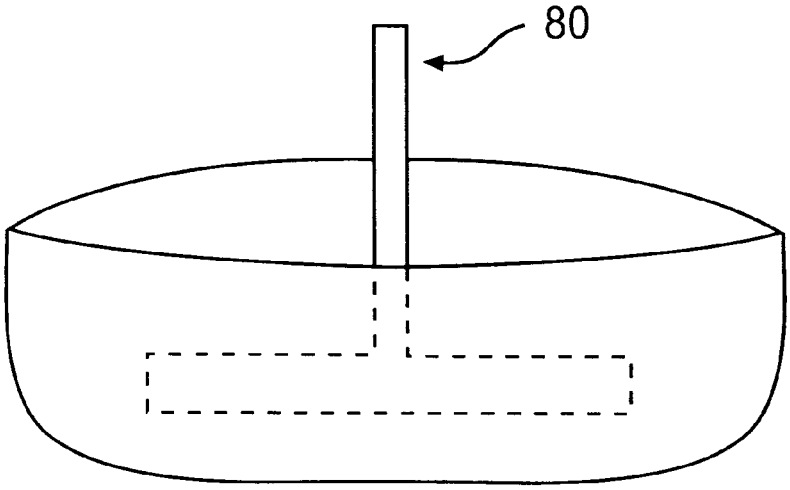

FIG. 6 is a schematic view of a bowl for containing and mixing hair product; and FIG. 7 is a schematic view of a mixing device for containing and mixing hair product Reference will now be made in detail to the present preferred embodiments of the invention, examples of which are illustrated in the accompanying drawings. Wherever possible, the same reference numbers are used in the drawings and the description to refer to the same or like parts, and the same reference numerals with different alphabetical suffixes are used to refer to similar parts.

Figure 2A:
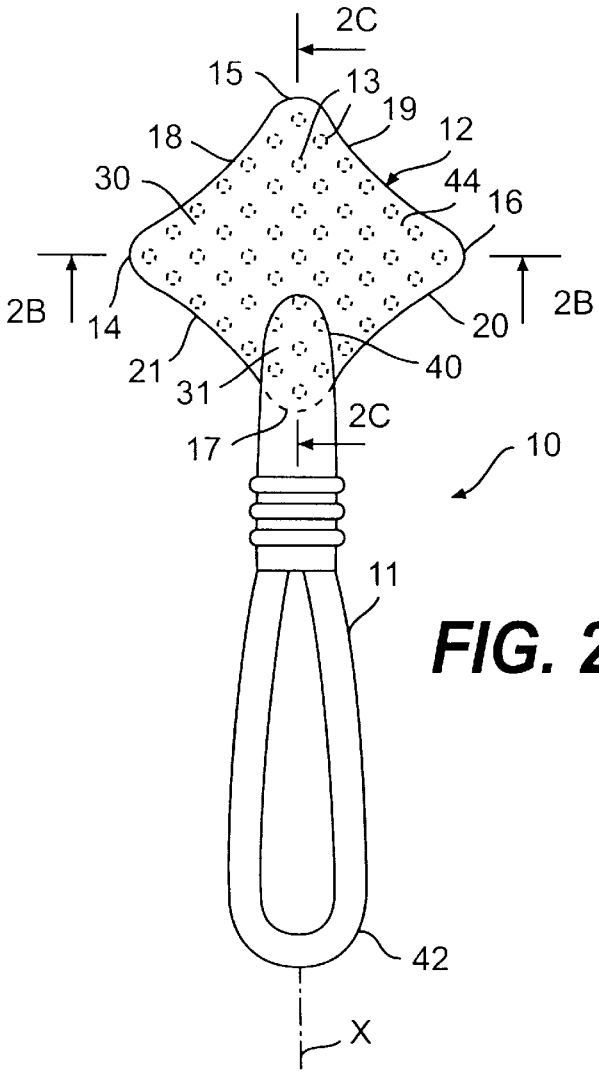
FIG. 2A is view showing an embodiment of an applicator according to the present invention.
Figure 2B:
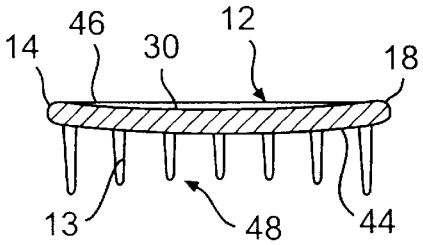
FIG. 2B is a transverse cross-sectional view taken along line 2B—2B of FIG. 2A.
Figure 2C:
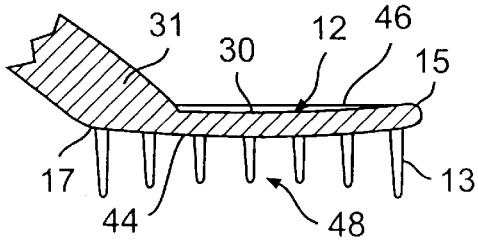
FIG. 2C is a partial longitudinal cross-sectional view taken along line 2C—2C of FIG. 2A.

An applicator 10, depicted in FIGS. 2A–2C, includes a handle 11 having a first end 40, a second end 42, and a longitudinal axis X. The applicator 10 further includes a brush 12 on the first end 40 of the handle 1 1. The brush 12 includes a base 30 having a first side 44, a second side 46, and a plurality of brush members 13 extending from the first side 44. Preferably, the brush members 13 are embedded in the first side 44 so that the brush members 13 are perpendicular to the first side 44. Preferably, the brush members 13 include teeth. However, in an alternative embodiment, the brush members 13 include bristles arranged in the form of tufts. In a preferred embodiment, the brush 12 is joined to the handle 11 at a junction 31, located on the second side 46 of the base 30.

Preferably, the handle 11 of the applicator 10 is manufactured so that the handle 11 is ergonomically optimized to achieve maximum comfort and aesthetic appeal for the user. In a preferred embodiment, the applicator 10 is molded from a thermoplastic material. Preferably, the thermoplastic material is chosen from polyethylene and polypropylene.

Preferably, the base 30 has a first side edge 18, a second side edge 19, a third side edge 20, and a fourth side edge 21. Preferably, the respective pairs of adjacent side edges 21/18, 19/20, 18/19, and 20/21 of the base 30 form a first protrusion 14 extending in a first direction substantially perpendicular to the axis X of the handle 11, a second protrusion 16 extending in a second direction substantially opposite to the first direction and substantially perpendicular to the axis X, a third protrusion 15 extending in a third direction facing away from the handle 11 and substantially parallel to the axis X, and a fourth protrusion 17 extending in a fourth direction substantially opposite to the third direction. Preferably, the third protrusion 15 and the fourth protrusion 17 are aligned with the axis X of the handle 11 and the first protrusion 14 and the second protrusion 16 are aligned substantially along a line substantially perpendicular to the axis X.

Preferably the protrusions 14–17 are curved and have a radius of curvature. In a preferred embodiment, the radius of curvature is from about 1 mm to about 15 mm. However in a more preferred embodiment, the radius of curvature is from about 2 mm to about 10 mm. In an alternate embodiment, the protrusions 14–17 are corners formed by the intersection of the respective pairs of adjacent side edges 21/18, 18/19, 19/20, and 20/21. Preferably, the respective side edges form substantially a right angle.

Preferably, the side edges 18–21 of the base 30 between the protrusions 14–17 are concavely curved so that the applicator does not create a color line near the starting zone.

Referring to FIGS. 2B and 2C, the second side 46 of the base 30 is preferably slightly concave, and the first side 44 is slightly convex. Preferably, the brush members 13 extend from the slightly convex first side 44. This configuration makes it possible for the user to apply the product deposited on the brush 12 more thoroughly.

Preferably, the free ends of the brush members 13 define a concave surface 48, extending from the convex first side 44 of the base 30. This configuration enables the convex profile of the head to be followed more closely, and also enables more product to be deposited on the brush 12.

Figure 3A:
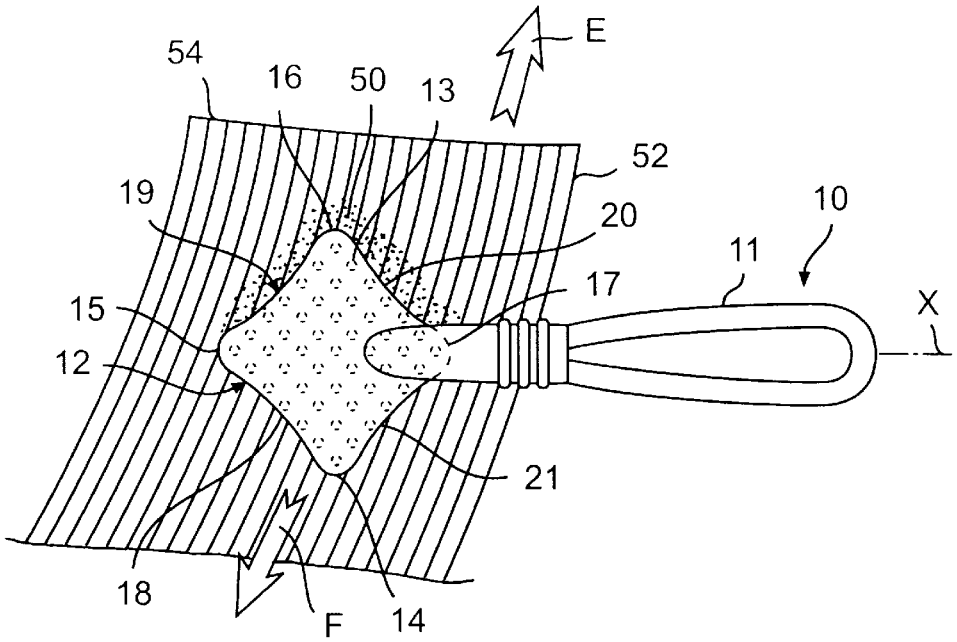
FIG. 3A is a view showing the application of a hair product using the applicator of FIGS. 2A–2C with the handle maintained substantially perpendicular to the lock of hair being treated.
Figure 3B:
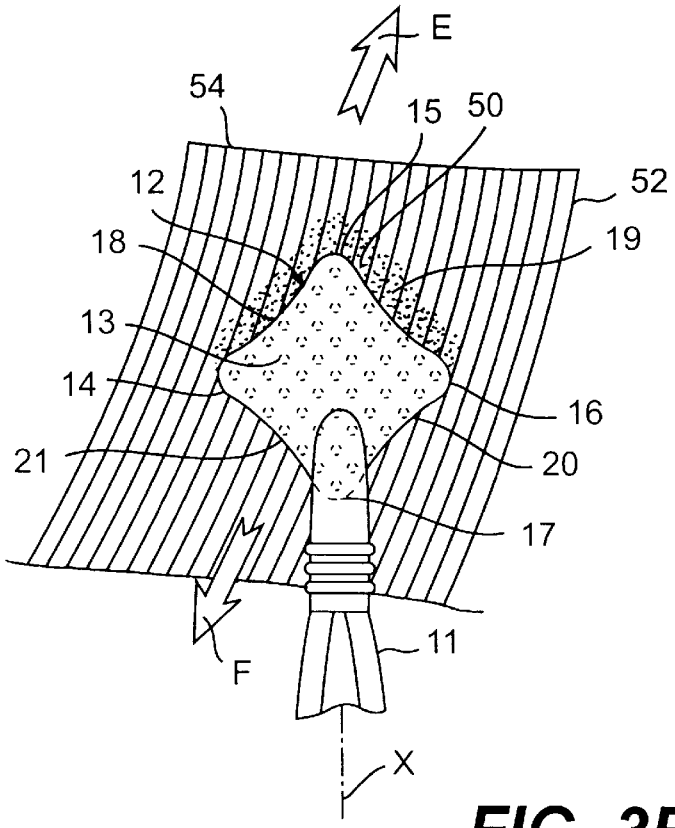
FIG. 3B is a view showing the application of a hair product using the applicator of FIGS. 2A–2C with the handle maintained substantially parallel to the lock of hair being treated.

FIGS. 3A and 3B depict a preferred method of using the applicator 10 of FIGS. 2A–2C. In the preferred method, the user places hair product 50 on the brush members 13 of the applicator 10. Next, the user positions the applicator 10 on a lock of hair 52 so that at least one of the protrusions 14–17 faces in a first direction E substantially toward the roots 54 of the lock of hair 52 . Finally, the user moves the applicator 10 in a second direction F along the lock of hair 52 to transfer the hair product 50 from the brush members 13 to the lock of hair 52. The second direction F is substantially opposite to the first direction E so that at least one of the protrusions 14–17 limits formation of a substantially straight initial color line.

As shown in FIG. 3A, preferably, the axis X of the handle 11 is maintained substantially perpendicular to the second direction F when the applicator 10 is moved along the lock of hair 52. In the alternative, as shown in FIG. 3B, the axis X of the handle 11 is maintained substantially parallel to the second direction F when the applicator 10 is moved along the lock of hair 52.

Preferably, the hair product 50 is a coloring product that is packaged as a cream or paste and prepared in a bowl or an automatic mixing device.

Figure 1A:
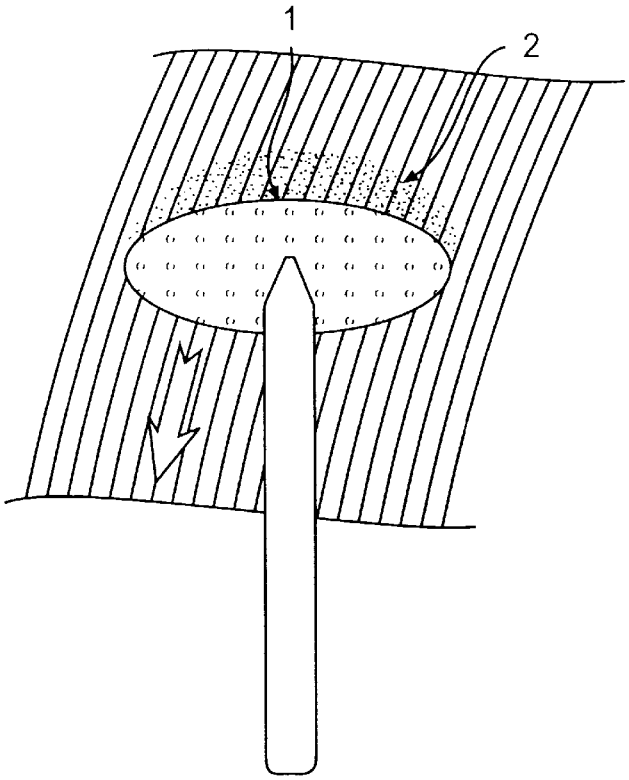
FIG. 1A PRIOR ART
Figure 1B:
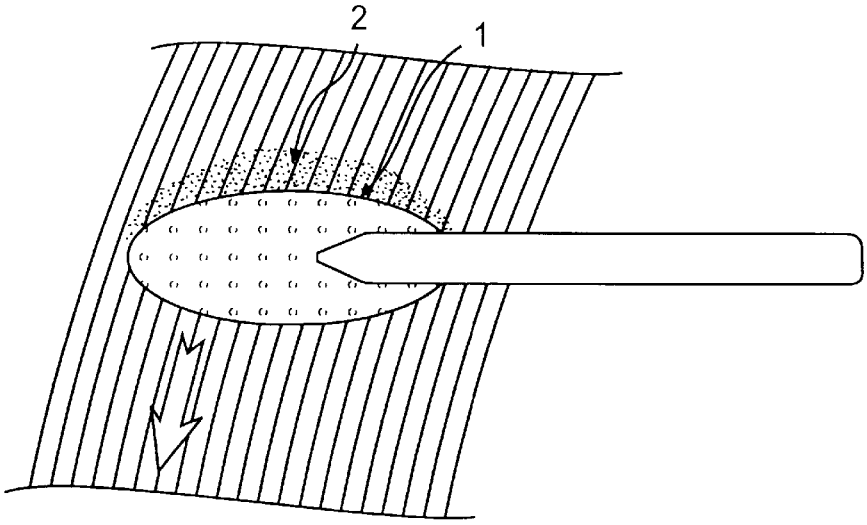
FIG. 1B PRIOR ART

Referring to FIG. 3A, the starting portion of the applicator 10 is formed by the protrusion 16 and the two adjacent side edges 19 and 20 (the protrusion 15 and the two adjacent side edges 18 and 19 form the starting portion in FIG. 3B). Because of the shape of the applicator 10, the width of the starting zone varies progressively from the width of the protrusion 16 to the maximum width of applicator 10 defined by the distance between the two protrusions 15 and 17 (for FIG. 3B, the starting zone varies from the width of the protrusion 15 to the distance between the two protrusions 14 and 16). Unlike the conventional applicators of FIGS. 1A and 1B, application of the product starts progressively because of the small radius of curvature of the starting zone and because of the substantially 450 orientation of the edges 19, 20 (FIG. 3A) relative to the direction of movement F of the applicator 10. Application of the hair coloring using an applicator with this configuration results in hair coloring that is remarkably natural looking.

Although not illustrated, an alternate preferred method includes applying the hair product 50 to the lock of hair 52 by moving the applicator 10 from the front of the head to the back of the head, wherein either the protrusion 14 or the protrusion 16, for example, forms the starting portion for the applicator 10. It should be observed that because of the symmetrical shape of the applicator 10, the characteristics of applicator 10 are substantially identical, whether the applicator 10 is used by a left-handed person or a right-handed person.

Although the preferred method is illustrated using the preferred applicator 10, those skilled in the art will recognize that the method could be practiced with other applicators, such as an applicator including a brush having a base including a plurality of brush members and a plurality of protrusions oriented in directions different from the brush members shown in the drawings.

Figure 4:
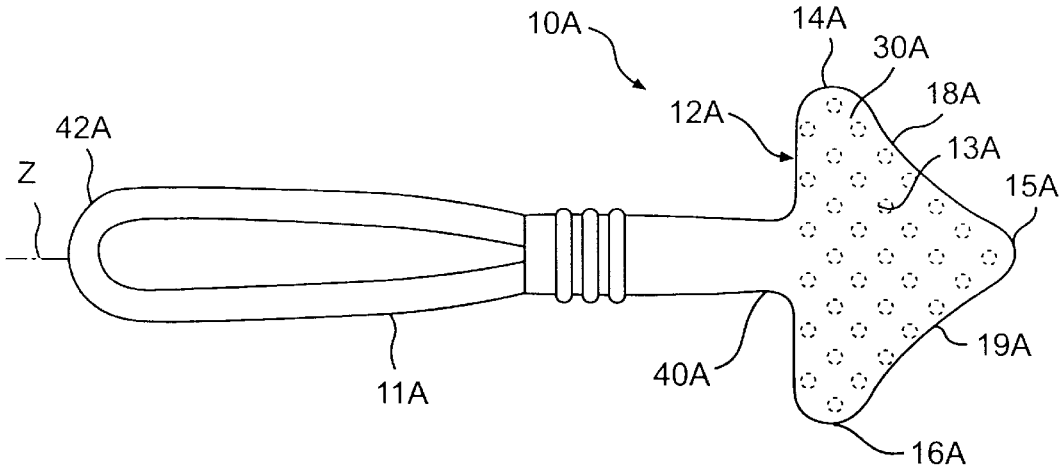
FIG. 4 is a view showing a second embodiment of an applicator.

Referring to FIG. 4, in an alternate embodiment, an applicator 10A includes a handle 11A having a first end 40A, a second end 42A, and a longitudinal axis Z. The applicator 10A further includes a brush 12A including a base 30A and brush members 13A. The base 30A includes a first protrusions 14A, a second protrusion 15A, and a third protrusion 16A, forming a shape similar to a three-leafed trefoil. Preferably, the protrusions 14A and 16A are aligned substantially along a line substantially perpendicular to the axis Z of the handle 11A. Preferably, the third protrusion 15A is substantially aligned along the axis Z opposite from the second end 42A of the handle 11A. Preferably, the protrusions 14A, 15A, and 16A are formed by concave side edges 18A and 19A of the base 30A. Although the area of application of the applicator 10A is slightly less than the area of the applicator 10 of FIGS. 2A–2C, both of the applicators 10 and 10A, when used properly, preferably apply hair coloring without leaving an initial color line.

Figure 5:
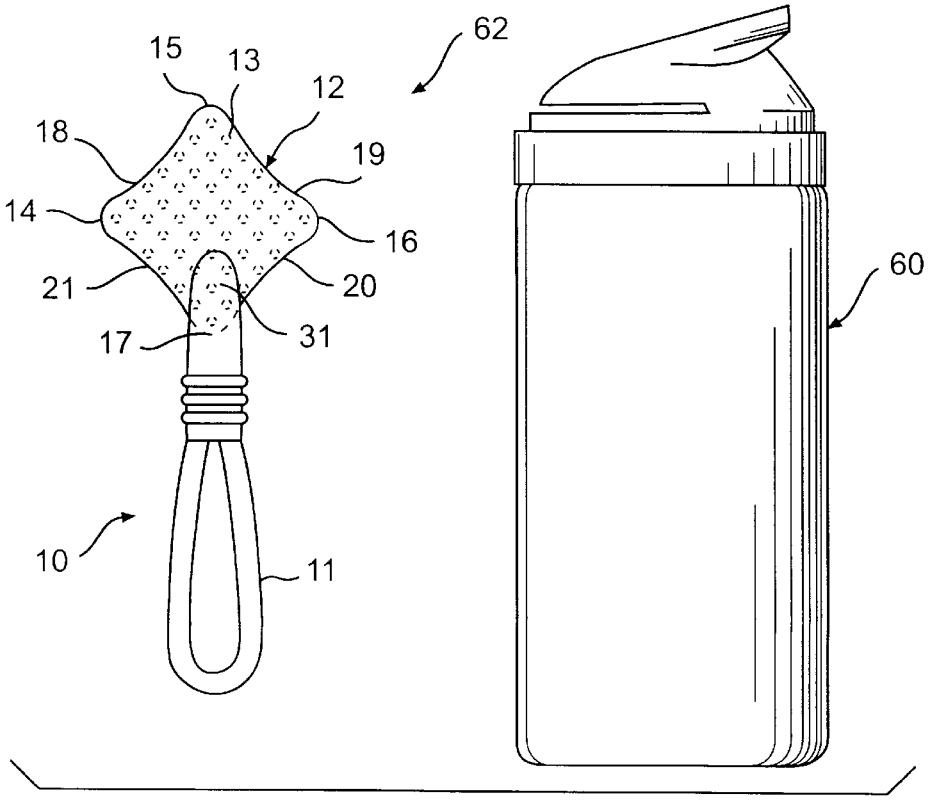
FIG. 5 is a view showing an embodiment of a system for applying a hair product to hair with the applicator of FIGS. 2A–2C and a pressurized container.

FIG. 5 depicts a system 62 for applying a hair product to hair. The system 62 includes the applicator 10 depicted in FIGS. 2A–2C in combination with a pressurized container 60 designed to deliver a hair product in the form of a mousse. In an alternate embodiment shown schematically in FIG. 6, the system 62 includes a bowl 70 for hand mixing the hair product (for example, a dye and an oxidizing agent). In yet another embodiment, shown schematically in FIG. 7, the system 62 includes a mixing device 80 capable of mixing the constituents of a hair product automatically. Such mixing devices are well-known in the art and consequently require no further description.

It will be apparent to those skilled in the art that various modifications and variations can be made to the structure and methodology of the present invention without departing from the scope or spirit of the invention. In view of the foregoing, it is intended that the present invention cover modifications and variations of this invention, provided they fall within the scope of the following claims and their equivalents.

What is claimed is:

1. An applicator for a hair product, comprising:

a handle having at least a first end, a second end, and a longitudinal axis; and a brush on the first end of the handle, the brush including a base and a plurality of brush members extending from the base, the brush members being configured to hold a sufficient amount of hair product for application, the base having at least three protrusions including a first protrusion extending in a first direction substantially perpendicular to the longitudinal axis of the handle, a second protrusion extending in a second direction substantially opposite to the first direction and substantially perpendicular to the longitudinal axis of the handle, and a third protrusion extending in a third direction facing away from the handle and substantially parallel to the longitudinal axis of the handle, the base lacking any edges substantially parallel to the longitudinal axis of the handle.

2. The applicator of claim 1, wherein each of the at least three protrusions is curved and has a radius of curvature.

3. The applicator of claim 1, wherein the base has a plurality of sides edges and each of the at least three protrusions is a corner formed by the intersection of two respective side edges of the base.

4. The applicator of claim 3, wherein the two respective side edges form substantially a right angle.

5. The applicator of claim 1, wherein the first protrusion and the second protrusion are aligned substantially along a line substantially perpendicular to the longitudinal axis of the handle, and wherein the third protrusion is substantially aligned with the longitudinal axis of the handle.

6. The applicator of claim 1, wherein the base includes a fourth protrusion extending in a fourth direction substantially opposite to the third direction.

7. The applicator of claim 6, wherein the third protrusion and the fourth protrusion are substantially aligned with the longitudinal axis of the handle.

8. The applicator of claim 7, wherein the base lacks any edges substantially perpendicular to the longitudinal axis of the handle.

9. The applicator of claim 1, wherein the base includes curved side edges between the protrusions.

10. The applicator of claim 9, wherein the curvature of the side edges is concave.

11. The applicator of claim 1, wherein the brush members extend from a surface of the base having a concave curvature.

12. The applicator of claim 1, wherein free ends of the brush members define a concave curvature.

13. The applicator of claim 11, wherein free ends of the brush members define a concave curvature, the brush being configured so that the concave curvature of the surface of the base faces away from the concave curvature defined by the free ends of the brush members.

14. The applicator of claim 2, wherein the radius of curvature is from about 1 mm to about 15 mm.

15. The applicator of claim 2, wherein the radius of curvature is from about 2 mm to about 10 mm.

16. The applicator of claim 1, wherein the applicator is molded from a thermoplastic material.

17. The applicator of claim 16, wherein the thermoplastic material is chosen from polypropylene and polyethylene.

18. A system for applying a hair product to hair, comprising:

the applicator of claim 1; and a container for containing the hair product.

19. The system of claim 18, wherein the container contains a hair coloring substance.

20. The system of claim 18, wherein the container is a bowl.

21. The system of claim 18, wherein the container is a mixer.

22. The system of claim 18, wherein the container is pressurized.

23. The applicator of claim 1, wherein the brush members are chosen from teeth and brushes.

24. The applicator of claim 1, wherein the brush members are substantially uniformly dispersed throughout an entire surface of the base.

25. The applicator of claim 1, wherein the brush members extend in a direction substantially perpendicular to the base.

26. The applicator of claim 1, wherein the brush members and the protrusions are configured to substantially prevent a line of product from forming when the applicator is moved along the hair in one of a direction substantially parallel to the longitudinal axis of the handle and a direction substantially perpendicular to the longitudinal axis of the handle.

27. An applicator for a hair product, comprising:

a handle having at least a first end, a second end, and a longitudinal axis; and a brush on the first end of the handle, the brush including a base and a plurality of brush members extending from the base, the base having at least three protrusions including a first protrusion extending in a first direction substantially perpendicular to the longitudinal axis of the handle, a second protrusion extending in a second direction substantially opposite to the first direction and substantially perpendicular to the longitudinal axis of the handle, and a third protrusion extending in a third direction facing away from the handle and substantially parallel to the longitudinal axis of the handle.

28. A method for applying a hair coloring to hair with an applicator having a base including a plurality of brush members and a plurality of protrusions, comprising:

placing the hair coloring on the brush members;

positioning the applicator on a lock of the hair so that at least one of the protrusions faces in a first direction facing substantially toward roots of the hair; and moving the applicator in a second direction along the lock of hair to transfer the hair coloring from the brush members to the hair, the second direction being substantially opposite to the first direction so that the at least one protrusion limits formation of a substantially straight initial color line.

29. The method of claim 28, wherein the applicator includes a handle extending from the brush, and wherein the handle is maintained substantially perpendicular to the second direction when the applicator is moved along the lock of hair.

30. The method of claim 28, wherein the applicator includes a handle extending from the brush, and wherein the handle is maintained substantially parallel to the second direction when the applicator is moved along the lock of hair.

* * * * *